US007150084B2

(12) United States Patent
Umino et al.

(10) Patent No.: US 7,150,084 B2
(45) Date of Patent: Dec. 19, 2006

(54) SLIDE FASTENER MANUFACTURING APPARATUS

(75) Inventors: Mitsugu Umino, Toyama (JP); Michio Ito, Toyama (JP); Osamu Fujii, Toyama (JP); Atsunori Sugimoto, Toyama (JP)

(73) Assignee: YKK Corporation, Tokyo (JP)

( * ) Notice: Subject to any disclaimer, the term of this patent is extended or adjusted under 35 U.S.C. 154(b) by 250 days.

(21) Appl. No.: 10/884,913

(22) Filed: Jul. 6, 2004

(65) Prior Publication Data

US 2005/0066499 A1 Mar. 31, 2005

(30) Foreign Application Priority Data

Sep. 26, 2003 (JP) ..... P. 2003-336038

(51) Int. Cl.

| | |
|---|---|
| ***B23P 15/00*** | (2006.01) |
| ***A44B 19/42*** | (2006.01) |
| ***A44B 19/60*** | (2006.01) |
| ***A44B 19/62*** | (2006.01) |

(52) U.S. Cl. ..... 29/33.2; 29/563; 29/38 A; 29/408; 29/766; 29/767; 29/768

(58) Field of Classification Search ..... 29/33.2, 29/408, 766, 767, 768, 563, 38 A, 38 C, 29/409–410, 33 K; 156/66

See application file for complete search history.

(56) References Cited

U.S. PATENT DOCUMENTS

| | | | | |
|---|---|---|---|---|
| 2,879,588 A | | 3/1959 | Morin | |
| 3,138,852 A | * | 6/1964 | Mazura | 29/710 |
| 3,792,521 A | * | 2/1974 | Kawakami | 29/712 |
| 4,163,313 A | * | 8/1979 | Matsuno et al. | 29/563 |
| RE31,751 E | * | 12/1984 | Hakoi | 29/766 |
| 4,619,141 A | | 10/1986 | Yoshieda et al. | |
| 4,747,210 A | * | 5/1988 | Suzuki | 29/768 |
| 5,815,902 A | * | 10/1998 | Osterried et al. | 29/38 A |
| 6,178,608 B1 | * | 1/2001 | Koch | 29/33 P |
| 6,442,819 B1 | * | 9/2002 | Kettner | 29/408 |
| 6,722,236 B1 | * | 4/2004 | Baldini et al. | 82/117 |
| 2003/0029697 A1 | * | 2/2003 | Green et al. | 198/377.02 |

FOREIGN PATENT DOCUMENTS

| | | |
|---|---|---|
| CN | 2430877 | 5/2001 |
| EP | 0771538 | 5/1997 |
| JP | 6-209810 | 8/1994 |
| JP | 6-71446 | 9/1994 |
| JP | 7-40962 | 5/1995 |

* cited by examiner

*Primary Examiner*—Erica Cadugan
(74) *Attorney, Agent, or Firm*—Everest Intellectual Property Law Group; Michael S. Leonard

(57) ABSTRACT

Machining portions such as a cutter portion, a slider inserting portion and an upper stopper attaching portion are provided around the vertical axis of a fixed table portion in order of machining. A fastener chain cut to have a predetermined length is held by the fixed table portion and a gripper of a rotator provided around the same vertical axis. The fastener chain is rotated and transferred to each of the machining portions based on the intermittent rotation and control of the rotator in the holding state in the gripper. Every time a predetermined machining is completed in each of the machining portions for the fastener chain rotated and transferred intermittently, it is possible to rotate and transfer the fastener chain simultaneously and intermittently to the next machining portion, thereby carrying out the necessary machining continuously.

12 Claims, 13 Drawing Sheets

SLIDE FASTENER MANUFACTURING APPARATUS

BACKGROUND OF THE INVENTION

1. Field of the Invention

The present invention relates to an apparatus for manufacturing a slide fastener chain which shapes like a rotary table, and more particularly to a slide fastener manufacturing apparatus which can sequentially carry out a predetermined machining by intermittently rotating and transferring a plurality of fastener stringers in a holding state for each of a plurality of machining portions arranged on a circumference.

2. Description of the Related Art

Conventionally, there has been used an apparatus for manufacturing a fastener chain which attaches a slider and an upper stopper to carry out a machining while holding a continuous slide fastener chain (hereinafter referred to as a fastener chain) in a horizontal state and moving the same slide fastener chain in a longitudinal direction thereof, for example (see JP-A-6-209810, for example).

In an apparatus 100 for manufacturing a fastener chain described in JP-A-6-209810, various machining portions such as a cutter portion 101, a slider inserting portion 102 and an upper stopper attaching portion 103 are sequentially arranged in series along a moving path in the longitudinal direction of a fastener chain C as shown in FIG. 16.

When the fastener chain C is to be finished by using the conventional fastener chain manufacturing apparatus 100, a tip portion in the longitudinal direction of the fastener chain C in a closing state is held horizontally by means of a pair of left and right inserting grippers 104 and 104 and the fastener chain C is transferred over the cutter portion 101, the slider inserting portion 102 and the upper stopper attaching portion 103. During the transfer of the fastener chain C, a slider 105 is inserted through the fastener chain C and an upper stopper 106 is attached to the fastener chain C divided into two portions by the insertion of the slider 105 respectively. The rear end of the fastener chain C reaching the cutter portion 101 is cut to finish the fastener chain C in a predetermined length. By sequentially repeating this operation, the next fastener chain C having a predetermined length is finished.

In the same manner as the technique described in JP-A-6-209810, moreover, there has been known another fastener chain manufacturing apparatus having a plurality of machining portions provided serially from a supply side to a discharge side of the fastener chain (see JP-B-6-71446 and JP-B-7-40962, for example).

Also in the fastener chain manufacturing apparatuses described in JP-B-6-71446 and JP-B-7-40962, various machining such as the insertion of a slider and the attachment of an upper stopper are carried out while the fastener chain is transferred horizontally over each machining portion. JP-A-6-209810, JP-B-6-71446 and JP-B-7-40962 have been proposed by the applicant.

JP-A-6-209810, JP-B-6-71446, and JP-B-7-40962 are referred to as related art.

The fastener chain manufacturing apparatus 100 described in each of JP-A-6-209810, JP-B-6-71446 and JP-B-7-40962 is configured by serially providing each of the machining portions such as the cutter portion 101, the slider inserting portion 102 and the upper stopper attaching portion 103 along a transfer path extended on a straight line.

For this reason, the fastener chain C is transferred in a horizontal state over all of the machining portions 101 to 103 provided on the straight line from the supply side toward the discharge side of the fastener chain C so that the single fastener chain C having a predetermined length to be a product object can be processed as described above.

In the conventional fastener chain manufacturing apparatus 100, however, only the single fastener chain C can be transferred and predetermined machining are sequentially carried out one by one in the machining portions 101 to 103, and the next fastener chain C cannot be transferred until all of the machining works of the machining portions 101 to 103 are completed in respect of a structure thereof. In other words, the next fastener chain C cannot be started to be processed until the fastener chain C having the predetermined length to be formed into a product is transferred over all of the machining portions 101 to 103.

Consequently, the operation of a machining device in each of the machining portions 101 to 103 is completed in order of the machining and the former fastener chain C is discharged from the manufacturing apparatus, and thereafter, the operation of the machining device is inevitably repeated sequentially to carry out the machining over the next fastener chain C in the same manner as the former fastener chain C.

As a result, the machining devices of the machining portions 101 to 103 completing the machining are to stop the operations until the operations of the machining devices of all the machining portions 101 to 103 for the fastener chain C are completed, and are to stand by for a time taken until the next fastener chain C is transferred. Moreover, the machining device which has not carried out the machining is to stand by without doing anything until the fastener chain C reaches a machining position. Accordingly, there is a problem in that the standby time of the machining device is prolonged, resulting in a deterioration in the operation efficiency of the machining device. In addition, there is also a problem in that the cycle time of a machining is prolonged, resulting in an increase in a machining cost per product.

The conventional fastener chain manufacturing apparatus has introduced various automatic apparatuses to be used for a necessary measurement for an automatic operation other than the machining to be carried out by each of the machining portions and the confirmation and check of a machining part. In the case in which the automatic apparatus of this type is to be introduced, there is also a problem in that the cycle time of the machining is prolonged still more together with the machining time of each of the machining portions and a machining cost per product is increased very sharply.

In the conventional fastener chain manufacturing apparatus, thus, when the automatic apparatus is introduced into existing equipment, a working efficiency is deteriorated. Consequently, there has been a limit to mass-produce the product with high precision in a predetermined cycle time or to carry out a high-speed production.

SUMMARY OF THE INVENTION

An object of the invention is to provide a slide fastener manufacturing apparatus capable of shortening a time required for manufacture by a machining, reducing a machining cost and manufacturing a product at a high speed.

The invention provides a slide fastener manufacturing apparatus for manufacturing a slide fastener, having: a fixed table portion; a plurality of machining portions for machining a fastener chain to manufacture the slide fastener, each of the machining portions is provided at the fixed table portion at a predetermined angle and in order of the machining by the plurality of the machining portions; a rotator for intermittently rotating at the predetermined angle and in parallel with the fixed table portion; and a plurality of holding portions for holding the fastener chain, each of the holding portions is disposed at the rotator at the predetermined angle.

Furthermore, the holding portion has: a pair of left and right grippers for holding the fastener chain; and operating portions for operating the pair of grippers to be closed or be separated each other.

Furthermore, the plurality of machining portions has, as each of the machining portions,: a cutter portion for cutting the fastener chain to have a predetermined length; a slider attaching portion for attaching a slider to the fastener chain cut by the cutter portion, an upper stopper attaching portion for attaching an upper stopper to the fastener chain to which the slider is attached; and a chain discharging portion for discharging a slide fastener as the fastener chain to which the slider and the upper stopper is attached out of a rotation and transfer path of the rotator.

Furthermore, the cutter portion has: chain delivering portions for delivering the fastener chain toward the holding portion; and a cutting blade for cutting the fastener chain delivered by the chain delivering portions.

Furthermore, the slider attaching portion includes: a slider delivering chute for delivering the slider; a slider stopper portion, which is urged on the slider delivering chute, for temporarily holding the slider delivered through the slider delivering chute; and a slider transferring portion for moving toward and backward the slider stopper portion to transfer the slider held by the slider stopper portion one by one, wherein when the slider transferring portion transfers the slider to a position where the slider is to be attached to the fastener chain, the slider stopper portion moves to an outside of a path of the slider transferring portion against an urging force thereof with the movement of the slider transferring portion, the slider stopper portion then returns to an original position by the urging force after the slider transferring portion moves beyond the slider stopper portion.

Furthermore, the slider transferring portion has: a first slider fixing portion for supporting an upper blade plate of the slider, and a second slider fixing portion for supporting a lower blade plate of the slider, wherein the first slider fixing portion and the second slider fixing portion are closed or separated each other.

Furthermore, the upper stopper attaching portion includes: an upper stopper delivering chute for aligning and delivering a plurality of upper stoppers; an upper stopper taking portion for taking the upper stoppers one by one out of the upper stopper delivering chute; and an upper stopper transferring portion for transferring the upper stopper taken our by the upper stopper taking portion to a position where the upper stopper is to be attached to the fastener chain, and the upper stopper transferring portion includes a fastening portion for fastening the upper stopper to the fastener chain.

Furthermore, the upper stopper is in a U shape having two leg portions, and the upper stopper taking portion has a fitting protrusion for fitting between the leg portions to support the upper stopper.

Furthermore, the fastening portion has a pair of first and second pressing portions which close or separate each other, and each of the pressing portions has a fitting concave portion to which the upper stopper supported by the fitting protrusion of the upper stopper taking portion is inserted.

Furthermore, each of the machining portions has a driving portion to be independently operated respectively.

Furthermore, the machining portions are provided at an edge of the fixed table portion, and the holding portions are disposed at an edge of the rotator.

Furthermore, the machining portions are provided around a vertical axis of the fixed table portion, the rotator is provided to enable to rotate around the vertical axis.

In the slide fastener manufacturing apparatus, the machining portions are provided at the fixed table portion with a predetermined phase difference in order of the machining. The rotator is controllably rotatable intermittently at a predetermined angle. The holding portions for holding the fastener chain cut to have a predetermined length are fixed at the rotator at a predetermined angle.

In order to operate the slide fastener manufacturing apparatus, a space portion having no element train every predetermined interval is formed in a longitudinal direction on the fastener chain to be a machining object which has not been cut, and the element train in a mating state is formed between the space portions. A lower stopper is previously attached every tip portion in the direction of transfer of the element train. The fastener chain is transferred to the first machining portion of the fixed table portion.

In the first machining portion, the fastener chain which is transferred is held by the holding portion provided on the rotator in the vicinity of the upper part of a portion having the element train between the space portions and is cut in the space portion of the fastener chain in the vicinity of the upper part of the holding portion. The fastener chain thus cut is intermittently rotated and transferred to the machining portions of the fixed table portion based on the rotation control of the rotator. More specifically, in the case that a machining time in each of the machining portions has a variation, the rotation of the rotator is intermittently controlled every time the machining in the machining portion which requires the longest machining time is completed.

In each of the machining portions provided after the first machining portion, a predetermined machining is carried out over the fastener chain which is rotated and transferred. Every time the machining by each of the machining portions is entirely completed, the fastener chain is intermittently rotated and transferred to a next machining portion in a holding state by the holding portion on the rotator, and all of the machining for one fastener chain are ended while the rotator carries out one rotation.

The hold of the fastener chain which is completely subjected to all of the machining is released by the holding portion, and is discharged from the rotation and transfer path of the rotator. The holding portion releasing the hold of the fastener chain is returned to the first machining portion. A new fastener chain having a predetermined length is held by the holding portion returned to the first machining portion. The operation is sequentially repeated every time the fastener chain held by the holding portion is intermittently rotated at a predetermined angle to the machining portions of the fixed table portion.

Every time the fastener chain transferred to the first machining portion is cut to have the predetermined length, thus, the fastener chain thus cut can be intermittently rotated and transferred at a predetermined angle to each of the machining portions. Consequently, it is possible to carry out a predetermined machining for the cut fastener chains in order of the machining simultaneously and continuously.

As compared with the apparatus for manufacturing a slide fastener in which a former fastener chain is horizontally transferred to the machining portions arranged in series along the fastener chain transfer path extended on a straight line and all of the machining are carried out thereover, and a next new fastener chain is then transferred horizontally to each of the machining portions and all of the machining are carried out thereover as in the conventional art, a standby time in each of the machining portions can be eliminated and the operation efficiency of each of the machining portions can be enhanced very greatly. As a result, a time required for the manufacture of the manufacturing apparatus can be shortened considerably, and furthermore, a machining cost per product can be reduced so that the output of a product can be increased sharply. Moreover, the machining portions can be provided on a circumference. As compared with the case that the machining portions are provided linearly, therefore, a space for the slide fastener manufacturing apparatus can be reduced.

The holding portion can be configured by a pair of left and right grippers for holding the fastener chain and the operating portions for operating the pair of grippers to be closed or be separated each other.

The grippers can hold the fastener chain having a predetermined length and can be intermittently rotated and transferred at a predetermined angle to each of the machining portions of the fixed table portion by means of the rotator, and thereafter, a pair of left and right fastener tapes of the fastener chain can be moved in an optimum direction for a machining attitude in each of the machining portions by the operating portions for the pair of grippers.

In each of the machining portions, each fastener tape can be moved according to the machining attitude in each of the machining portions. Therefore, the fastener chain can be automatically aligned for each of the machining portions so that the machining of the fastener chain in each of the machining portions can always be carried out stably.

In the machining portion, it is possible to sequentially provide, with a predetermined phase difference, the cutter portion for cutting the fastener chain to have a predetermined length around the vertical axis of the fixed table portion, the slider attaching portion for attaching the slider to the fastener chain thus cut, the upper stopper attaching portion for attaching the upper stopper to the fastener chain to which the slider is attached, and the chain discharging portion for discharging, from the rotation and transfer path of the rotator, the finished slide fastener having the slider and the upper stopper attached thereto.

In order to carry out the predetermined machining over the fastener chain having the predetermined length, first of all, the fastener chain delivered continuously is transported to the cutter portion of the fixed table portion. The predetermined portion of the fastener chain, that is, the vicinity of the upper part of the portion having the element train between the space portions as described above is held by each holding portion of the rotator provided in the cutter portion. The cutting is carried out in the space portion of the fastener chain in the vicinity of the upper part held by each holding portion, and the fastener chain cut to have the predetermined length is held in each holding portion.

Next, the rotator is intermittently rotated toward the slider attaching portion in the next step, and the fastener chain cut to have the predetermined length is intermittently rotated and transferred to the slider attaching portion at a predetermined angle in a state that the same fastener chain is held in each holding portion.

In the slider attaching portion, the slider is attached to the fastener chain cut to have the predetermined length. After the slider is attached to the fastener chain, the rotator is intermittently rotated toward the upper stopper attaching portion in the next step to intermittently rotate and transfer the fastener chain in the holding state in each holding portion from the slider attaching portion to the upper stopper attaching portion in the next step at a predetermined angle.

In the upper stopper attaching portion, the upper stopper is attached to the fastener chain so that a finished fastener chain product can be obtained. Then, the rotator is intermittently rotated at a predetermined angle to intermittently rotate and transfer the finished fastener chain product toward the chain discharging portion. In the chain discharging portion, the hold of each holding portion for the finished fastener chain product is released and the finished fastener chain product is discharged from the rotator to the outside of the rotation and transfer path.

Thus, the operation can be repeated sequentially every time the fastener chain is periodically rotated and transferred sequentially to the cutter portion, the slider attaching portion, the upper stopper attaching portion and the chain discharging portion. Thus, a plurality of fastener chains can be processed in parallel at the same time.

According to the configuration, it is possible to continuously and efficiently carry out each of machining such as the cut of the fastener chain, the insertion of the slider through the fastener chain and the attachment of the upper stopper to the fastener chain, and furthermore, to transfer the fastener chain to the next step rapidly and smoothly.

Thus, various works for the fastener chain can be carried out in parallel at the same time. Therefore, it is possible to implement the rationalization and increase in the efficiency of the machining works for the fastener chain. In addition, it is possible to considerably enhance a working efficiency, to increase a productivity, to reduce a manufacturing cost, and furthermore, to relieve the burden of an operator.

The cutter portion can include the chain delivering portions for delivering the fastener chain toward the holding portion and the cutting blade for cutting the fastener chain delivered by the chain delivering portions.

The cutting blade can be driven in closing and separating directions to and from the fastener chain. After the fastener chain is delivered to have a predetermined length by the chain delivering portions, the fastener chain is held in each holding portion. In this state, the cutting blade is caused to close to the fastener chain, thereby cutting the fastener chain in the space portion in the vicinity of the upper part of each of the holding portions. Thus, the fastener chain can be cut to have the predetermined length prior to each of the serial machining such as the insertion of the slider into the fastener chain and the attachment of the upper stopper to the fastener chain. Consequently, subsequent machining can be carried out independently and efficiently.

The slider attaching portion can include the slider delivering chute for delivering the slider, the slider stopper portion for temporarily holding the slider delivered through the slider delivering chute, and the slider transferring portion for holding and transferring the sliders one by one. The slider stopper portion can be provided movably in an urged state in the position for crossing the slider delivering chute.

The slider transferring portion can include the first slider fixing portion for supporting the upper blade plate of the slider, and the second slider fixing portion for supporting the lower blade plate of the slider, and the slider fixing portions is configured to freely close and separate each other.

The slider delivered through the slider delivering chute can be temporarily held by the slider stopper portion provided movably in the urged state in the position for crossing the slider delivering chute. The slider transferring portion can hold the surface and back sides of the slider in the first and second slider fixing portions respectively and can move the held slider toward the position where the slider is to be inserted into the fastener chain.

When the slider transferring portion is moved, the slider stopper portion can be retreated to the outside of the transfer path for the slider transferring portion against an urging force thereof with the movement of the slider transferring portion. The slider transferring portion is moved beyond the slider stopper portion, and at the same time, the slider stopper portion can be returned to an initial standby position for crossing the slider delivering chute by an urging force thereof and can stand by to hold a new slider.

The slider transferring portion can be continuously moved toward the fastener chain held by the holding portion in a mating state and can introduce the upper end of the fastener chain into the slider. At the same time, the pair of holding portions is moved in such a direction as to separate from each other in exact timing. Consequently, it is possible to open, like a Y shape, the tip portion of the fastener chain held by the pair of holding portions.

According to the configuration, the slider stopper portion and the slider transferring portion can be provided to close to the slider attaching portion. Consequently, the work for attaching the slider can be carried out efficiently and continuously without interfering with the other machining portions.

The upper stopper attaching portion can include the upper stopper delivering chute for aligning and delivering a plurality of upper stoppers, the upper stopper taking portion for taking the upper stoppers out of the upper stopper delivering chute one by one, and the upper stopper transferring portion for holding and transferring the upper stopper taken out by the upper stopper taking portion to the position where the upper stopper is to be attached to the fastener chain. In addition, the upper stopper transferring portion can include the fastening portion for fastening the upper stopper to the fastener chain.

The upper stopper taking portion can take the upper stoppers out of the upper stopper delivering chute one by one and can be moved forward and backward between a position where the upper stopper is taken out and a position where the upper stopper transferring portion stands by. The upper stopper transferring portion can be moved independently of the upper stopper taking portion from the position where the upper stopper is taken out to a position where the upper stopper is fixed.

As the upper stopper, it is possible to use an upper stopper in a U shape having two leg portions. In this case, it is suitable that the upper stopper taking portion should be provided with the fitting protrusion for fitting between the leg portions to support the upper stopper.

The fitting protrusion of the upper stopper taking portion can fit, support and hold the leg portions of the upper stopper delivered through the upper stopper delivering chute and can transfer the upper stopper held in the upper stopper taking portion toward the upper stopper transferring portion.

The fastening means can be configured to cause a pair of first and second pressing portions to freely close and separate each other. Each of the pressing portions can be provided with the fitting concave portion to which the upper stopper supported by the fitting protrusion of the upper stopper taking portion is inserted.

The pair of first and second pressing portions of the upper stopper transferring portion can insert, guide, fit and support the upper stopper fitted and supported by the fitting protrusion of the upper stopper taking portion. When the upper stopper transferring portion starts to be moved toward one of the element trains of the fastener chain held in the holding portion, the upper stopper taking portion can be returned to an original position simultaneously with the start of the moving operation of the upper stopper transferring portion.

When the two sharp leg portions of the upper stopper reach one of the fastener tapes of the fastener chain with the movement of the upper stopper transferring portion, the left and right leg portions of the upper stopper are inserted through the fastener tape across the upper end of the element train in an opening state. At the same time, the left and right leg portions of the upper stopper are bent like an almost C shape inward from each other by the press of the pair of pressing portions of the upper stopper transferring portion, and the upper stopper can be attached to the fastener tape.

According to the configuration, the upper stopper taking portion and the upper stopper transferring portion can be provided to close to the upper stopper attaching portion. Consequently, it is possible to efficiently carry out the work for attaching the upper stopper without interfering with the other machining portions.

Each of the machining portions can include the driving portion to be independently operated respectively. The driving portion provided in each of the machining portions can be driven independently for each of the machining portions. The driving portion can be assembled into a single support portion and can be formed into a unit. Consequently, the size of the slide fastener manufacturing apparatus can be reduced. In addition, machining works can be carried out independently, smoothly and efficiently.

The machining portions may be provided at an edge of the fixed table portion, and the holding portions may be disposed at an edge of the rotator.

The machining portions may be provided around a vertical axis of the fixed table portion, the rotator may be provided to enable to rotate around the vertical axis.

DETAILED DESCRIPTION OF THE PREFERRED EMBODIMENTS

A preferred embodiment of the invention will be specifically described below with reference to the accompanying drawings.

Figure 1:
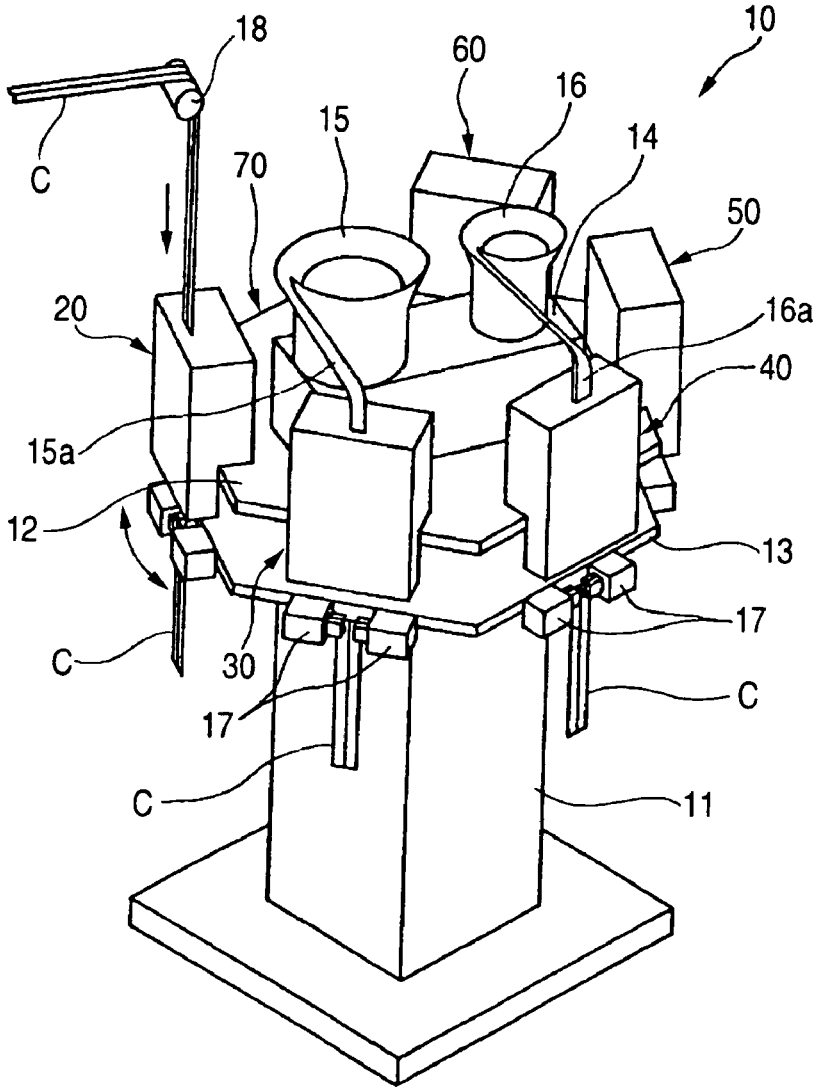
FIG. 1 is a general perspective view typically showing a slide fastener manufacturing apparatus according to a representative embodiment of the invention.

FIG. 1 is a general perspective view typically showing a slide fastener manufacturing apparatus according to a representative embodiment of the invention.

In FIG. 1, the reference numeral 10 denotes a slide fastener manufacturing apparatus taking the shape of a rotary table according to the embodiment. The slide fastener manufacturing apparatus 10 comprises a hexagonal fixed table portion 12 fixed above a rack 11, and a hexagonal rotator 13 provided in parallel under the fixed table portion 12. The rotator 13 is intermittently fixed and supported onto the rack 11 to be horizontally rotatable around the same vertical axis together with the fixed table portion 12.

A machining station for carrying out various machining over a fastener chain C obtained by cutting a long and continuous fastener chain C to have a predetermined length can be provided in the fixed table portion 12 around the same vertical axis in order of the machining with a predetermined phase difference. The fixed table portion 12 shown in the drawing has first to third machining portions and fourth to sixth processed portions. These machining and processed portions are provided with a phase difference of 60 degrees in the circumferential direction of the fixed table portion 12. Positions in which the machining and processed portions are to be provided are not restricted to an example shown in the drawing, but it is a matter of course that they can be provided in order of the machining with a phase difference of 45 or 72 degrees in the circumferential direction of the fixed table portion 12.

The first to third machining portions are configured by a cutter portion 20 for cutting the fastener chain C to have a predetermined length, a slider attaching portion 30 for inserting a slider 1 through the fastener chain C transferred from the cutter portion 20 which is cut to have the predetermined length and is unprocessed, and an upper stopper attaching portion 40 for attaching an upper stopper 2 to the fastener chain C transferred from the slider attaching portion 30. The fourth and fifth processed portions are configured by a pull erecting portion 50 for bringing down a pull 1*a* of the slider 1, and a chain discharging portion 60 provided adjacently to the downstream side of the pull erecting portion 50.

As the sixth processed portion, furthermore, the fixed table portion 12 shown in the drawing has a spare portion 70 provided between the chain discharging portion 60 and the cutter portion 20. The spare portion 70 can be provided with a checking apparatus for confirming and checking a finished fastener chain product discharged from the chain discharging portion 60 to the outside of a rotation and transfer path for the rotator 13 or/and various automatic apparatuses (not shown) to be used for a necessary measurement for intermittently and automatically operating each of the machining portions 20 to 40 at a predetermined angle and the confirmation and check of a machining time for each of the machining portions 20 to 40.

A detection value sent from a detecting sensor provided in each of the machining portions 20 to 40 can be input to various checking apparatuses provided in the spare portion 70. Moreover, the position of the spare portion 70 is exchanged with that of the chain discharging portion 60. Consequently, the finished fastener chain product checked in the spare portion 70 can also be discharged from the chain discharging portion 60 to an outside.

A support table 14 is provided on an upper surface in the central part of the fixed table portion 12. A slider delivering feeder 15 for delivering the slider 1 (FIG. 5) to the slider attaching portion 30 and an upper stopper delivering feeder 16 for delivering the upper stopper 2 (FIG. 8) to the upper stopper attaching portion 40 are mounted and fixed onto the support base 14. All the starting operations of the slide fastener manufacturing apparatus 10 are carried out by the manipulation of an operation control panel which is not shown.

The rotator 13 can be configured in such a manner that a rotation is intermittently controlled at a predetermined angle for each of the machining portions 20 to 40 and the processed portions 50 to 70 by a control device which is not shown. A pair of left and right holding portions 17 and 17 for holding fastener tapes T and T of a pair of left and right fastener stringers S and S in the fastener chain C having a predetermined length are fixedly provided at a predetermined angle in each of the machining portions 20 to 40 and the processed portions 50 to 70 in the rotator 13. Grippers 17 and 17 can be used as the holding portions 17 and 17. The fixed table portion 12 and the rotator 13 may be provided on a center and an outside over the same horizontal plane respectively, thereby holding the fastener chain C on the rotator 13 horizontally.

A set of gripper pair 17 and 17 shown in the drawing is provided with a phase difference of 60 degrees in the circumferential direction of the rotator 13. The driving operation of each of the grippers 17 can be controlled independently in closing and separating directions to and from each other corresponding to the movement of each of the machining portions 20 to 40 by means for operating a cylinder or a cam which is attached to a support portion which is not shown. The gripper 17 and the operating means constitute holding means to form a part of a main feature portion according to the invention. A position in which the gripper 17 is to be provided is not particularly restricted. By moving each of the grippers 17 through the operating means, moreover, it is also possible to correct the position of the fastener chain C in each of the machining portions 20 to 40.

Figure 2:
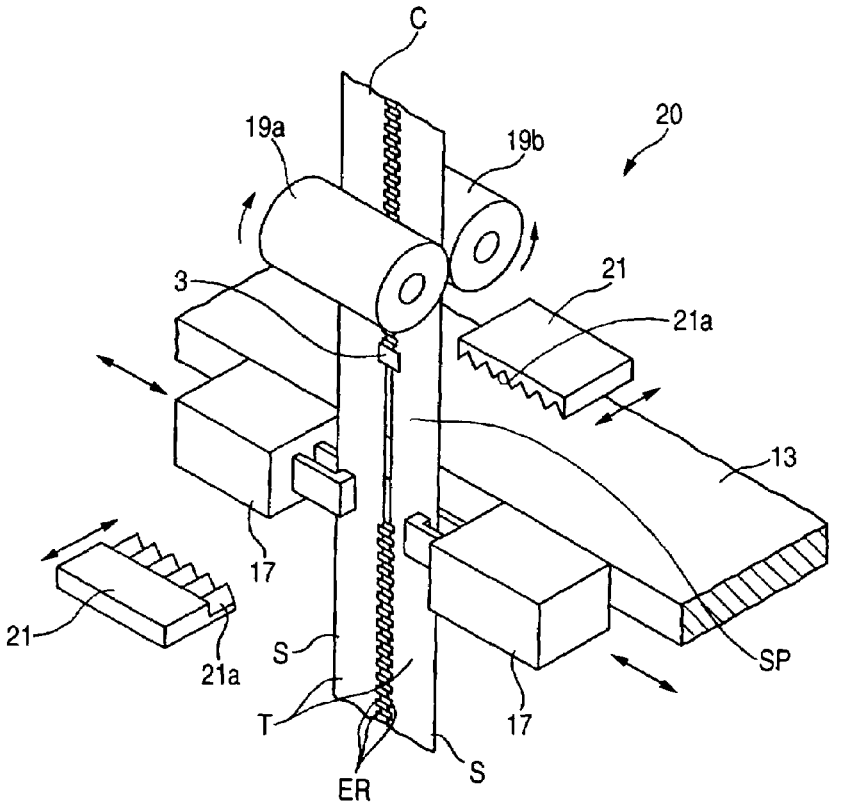
FIG. 2 is a perspective view showing the enlarged main part of a cutter portion to be applied to the apparatus.

FIG. 2 shows the enlarged main part of the cutter portion 20 to be applied to the slide fastener manufacturing apparatus 10.

In the continuous fastener chain C which is uncut, a space portion SP having no element train ER is formed at a predetermined interval as shown in FIG. 2. The element train ER in a mating state is formed between the space portions SP, and a lower stopper 3 is previously attached for each tip portion in the direction of transfer of each element train ER.

The fastener chain C is pulled out of a fastener supply portion (not shown) in a horizontal direction and is then hung in a downward direction through a guide roll 18 (FIG. 1) supported rotatably around the horizontal axis of the support portion which is not shown. The tip portion of the fastener chain C can be transferred intermittently and vertically to the cutter portion 20 to be the first machining portion through a driving roll 19*a* and a driven roll 19*b* which are chain delivering means supported rotatably around the horizontal axis of the support portion which is not shown. With this structure, the holding means is provided. Consequently, the fastener tape T can be held accurately and smoothly, and furthermore, the attitude of the fastener stringer S can always be maintained stably.

Figure 3:
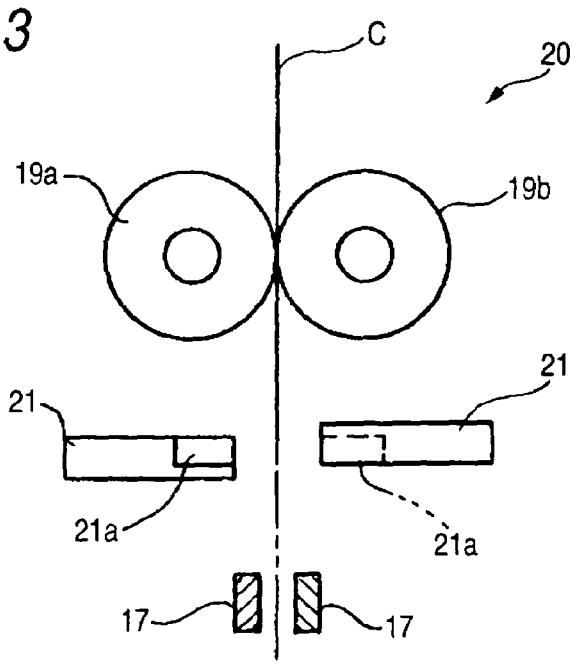
FIG. 3 is an explanatory view typically showing a state obtained immediately before a fastener chain is cut.
Figure 4:
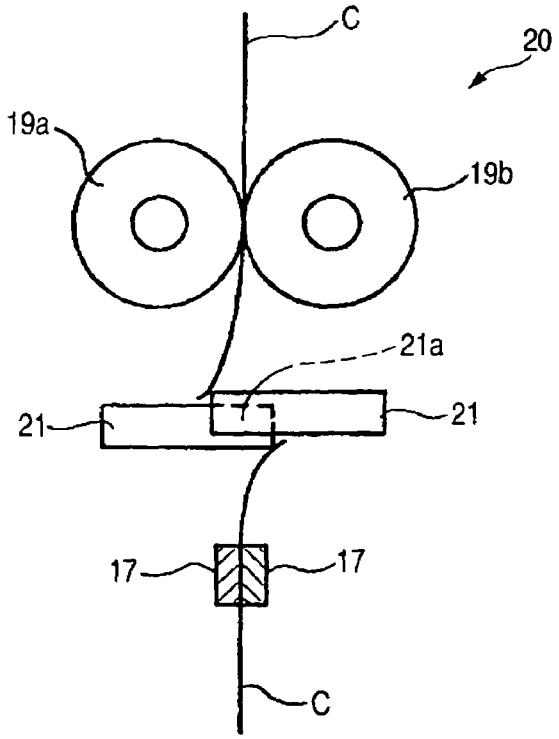
FIG. 4 is an explanatory view showing a subsequent operation to FIG. 3.

FIG. 3 typically shows a state obtained immediately before the fastener chain C is cut and FIG. 4 shows a subsequent operation to FIG. 3.

As shown in FIGS. 2 and 3, the cutter portion 20 has a pair of cutting blades 21 and 21 provided horizontally in the vicinity of the upper part of the gripper 17 to interpose a transfer path for the fastener chain C formed between the pair of grippers 17 and 17 and between the pair of rolls 19*a* and 19*b*. Each of the cutting blades 21 has a blade portion 21*a* for zigzag cutting the cut portion of the fastener chain C. Each of the cutting blades 21 can be configured to singly control the driving operation in closing and separating directions to and from each other toward the fastener chain C by the operating means such as a motor which is attached to the support portion which is not shown. Moreover, the fastener chain C can also be cut by a fixed die provided in the vicinity of the fastener chain C and a cutting blade closing toward the fixed die and coming in contact with the fastener chain C by a shock.

In the cutter portion 20, the fastener chain C having a predetermined length is transferred by the rotation of the driving roll 19*a* and the driven roll 19*b*, and the fastener tapes T of the fastener chain C are held by the grippers 17 respectively as shown in FIGS. 2 and 3. In the example shown in the drawing, the vicinity of the upper part of a portion having the element train ER between the space portions SP is held by each of the grippers 17. By causing the cutting blades 21 to close to each other in the holding state as shown in FIG. 4, the cutting can be carried out in the space portion SP of the fastener chain C in the vicinity of the upper part of the gripper 17.

The fastener stringer S of the fastener chain C which is cut and set in the mating state is maintained to be held by each of the gripers 17 and is intermittently rotated and transferred to the slider attaching portion 30 of the second machining portion to be a next step through the rotator 13. At the same time that the fastener chain C which is cut and set in the mating state is intermittently rotated and transferred to the slider attaching portion 30, a new fastener chain C is held by each of the grippers 17 of the rotator 13 returned with one rotation to the cutter portion 20 as described above, and the same operation as described above is repeated.

Figure 5:
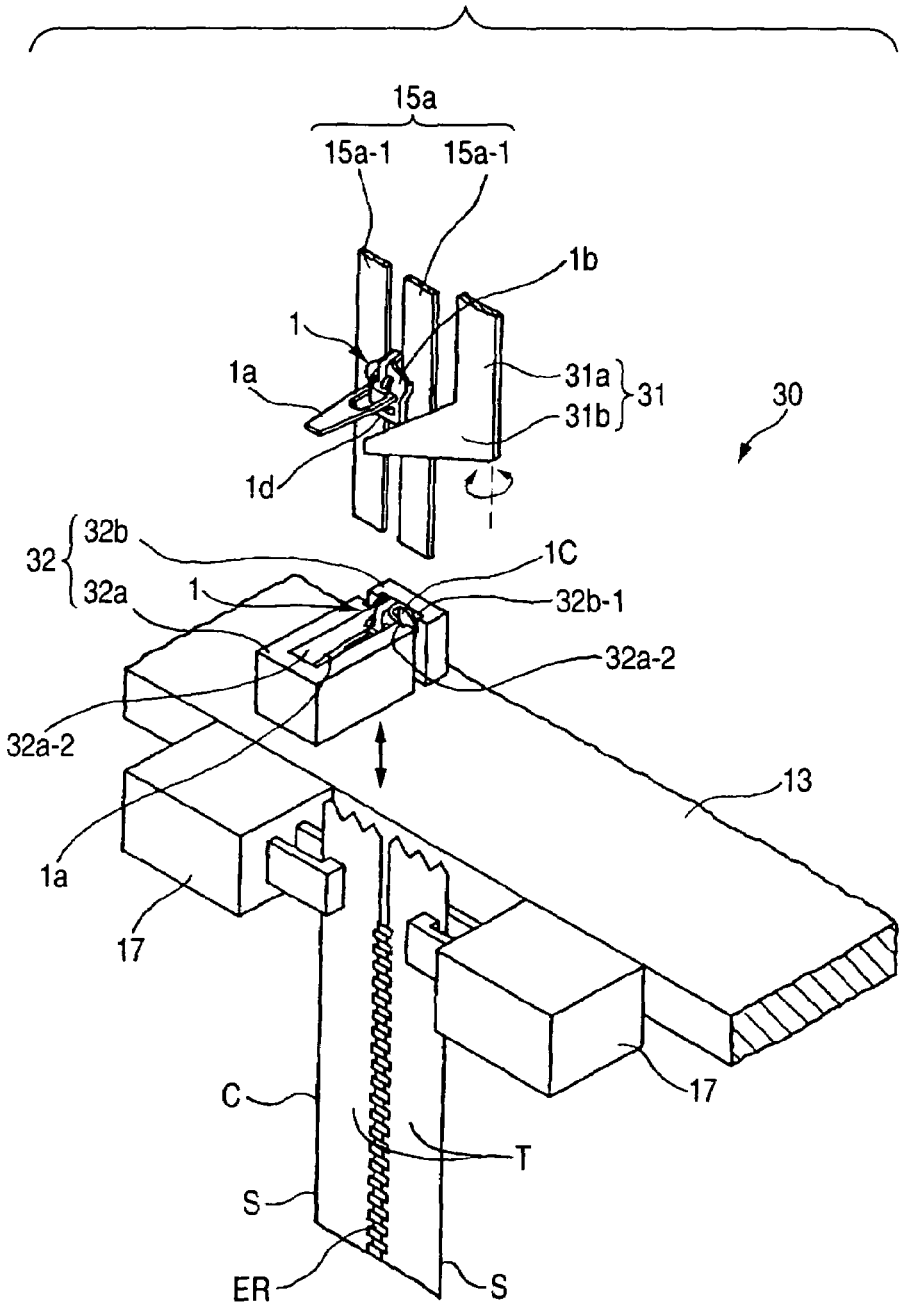
FIG. 5 is a perspective view showing the enlarged main part of a slider inserting portion to be applied to the apparatus.
Figure 6:
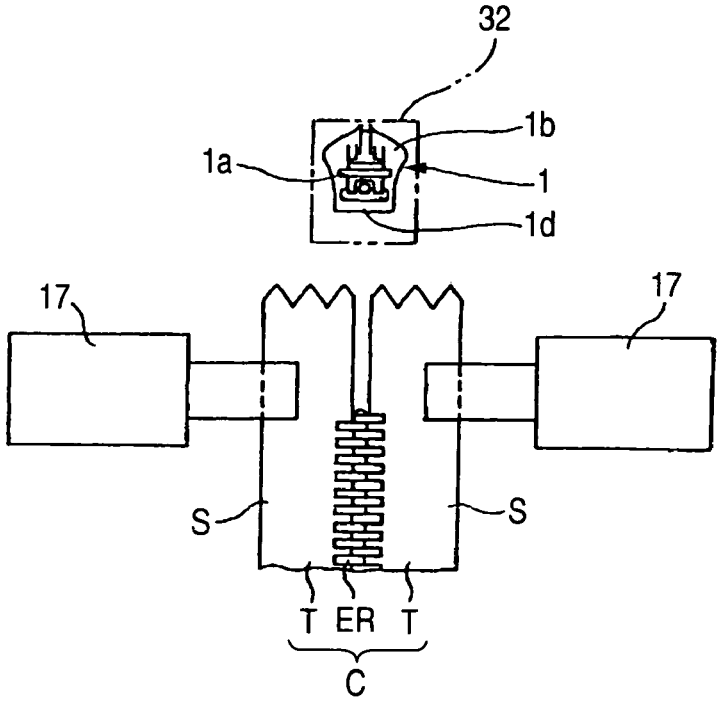
FIG. 6 is an explanatory view typically showing a state obtained immediately before a slider is inserted through a fastener stringer.
Figure 7:
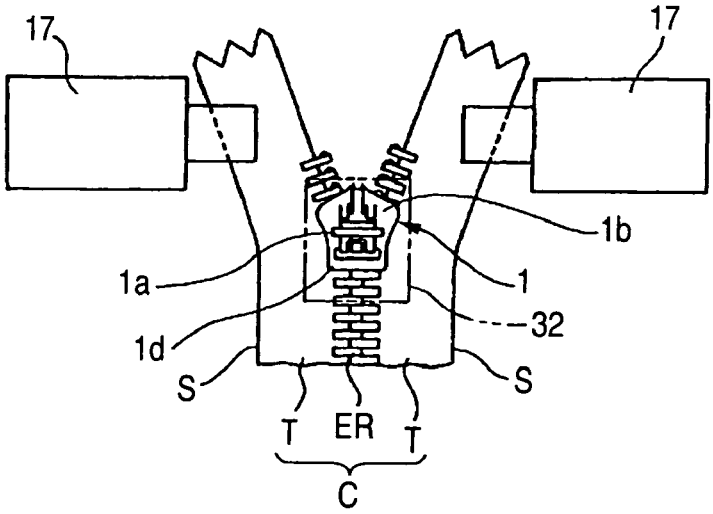
FIG. 7 is an explanatory view showing a subsequent operation to FIG. 6.

FIG. 5 shows the enlarged main part of the slider attaching portion 30, FIG. 6 typically shows a state obtained immediately before the slider 1 is inserted through the fastener stringer S, and FIG. 7 shows a subsequent operation to FIG. 6.

As shown in FIG. 5, the slider attaching portion 30 includes a slider stopper portion 31 for temporarily holding the slider 1 slipping down through a slider delivering chute 15*a* (hereinafter referred to as a chute 15*a*) from the slider delivering feeder 15, and a slider transferring portion 32 for holding and transferring, in a non-operation state, an upper blade plate 1*b* and a lower blade plate 1*c* of the slider 1 held on the chute 15*a* in the slider stopper portion 31.

The chute 15*a* serves to cause a rear port 1*d* of the slider 1 to slip down toward a slider introducing side in a state in which the pull 1*a* provided on the upper blade plate 1*b* of the slider 1 is erected upward as shown in FIG. 5. The upstream side of the chute 15*a* is downward inclined and extended from the slider delivering feeder 15 toward the slider attaching portion 30 as shown in FIG. 1. A downstream side thereof is bent and extended in a vertical direction toward a slider holding position by the slider transferring portion 32 as shown in FIG. 5.

The chute 15*a* is configured by a pair of slider introducing guide pieces 15*a*-1 and 15*a*-1 which are separated from each other at a predetermined interval as shown in FIG. 5. A slider introducing guide space is formed between the slider introducing guide pieces 15*a*-1. Each of the slider introducing guide pieces 15*a*-1 can insert and support an insertion space formed from the rear port 1*d* of the slider 1 to the upper blade plate 1*b* and lower blade plate 1*c* of the slider 1 and can introduce and guide the slider 1 along the slider introducing guide space formed between the slider introducing guide pieces 15*a*-1.

As shown in FIG. 5, the slider stopper portion 31 is provided on the downstream side of the chute 15*a*. The slider stopper portion 31 is configured by an almost inverse L-shaped bent plate portion including a vertical portion 31*a* rocked between a position for crossing the chute 15*a* and a position for retreating from the chute 15*a* and a horizontal portion 31*b* bent from the lower end of the vertical portion 31*a* toward the downstream side of the chute 15*a*.

The upper part of the vertical portion 31*a* of the slider stopper portion 31 is rockingly fixed and supported on a support portion which is not shown. The vertical portion 31*a* is always urged toward the chute 15*a* by urging means such as a compression coil spring which is not shown. The horizontal portion 31*b* of the slider stopper portion 31 can be configured to be elastically rotated in a direction for crossing the slider introducing guide pieces 15*a*-1 by setting the upper part of the vertical portion 31*a* to be a rocking fulcrum (clockwise and counterclockwise directions shown in an arrow of FIG. 5).

According to this simple configuration, the horizontal portion 31*b* of the slider stopper portion 31 can be caused to temporarily hold the slider 1 slipping down from the slider delivering feeder 15 through the chute 15*a* and only one slider 1 can be taken out of the chute 15*a* by means of the slider transferring portion 32 which will be described below.

The slider transferring portion 32 is provided on an extended line at the downstream side of the chute 15*a* as shown in FIG. 5. The slider transferring portion 32 is configured by first and second slider fixing portions 32*a* and 32*b* taking cubic shapes which are arranged on both sides in the diameter direction of the fixed table portion 12 with the horizontal portion 31*b* of the slider stopper portion 31 interposed therebetween. The slider fixing portions 32*a* and 32*b* are provided opposite to each other on the same horizontal plane and can be configured to close and separate each other. The slider fixing portions 32*a* and 32*b* can be assembled into the same support portion which is not shown and can be thus formed into a unit.

The first slider fixing portion 32*a* has a fitting concave portion 32*a*-1 for fitting and supporting the upper blade plate 1*b* of the slider 1 in a state in which the pull 1*a* of the slider 1 is erected with the rear port 1*d* of the slider 1 turned toward the downstream side of the chute 15*a* as shown in FIG. 5. The fitting concave portion 32*a*-1 is coincident with the shape of the contour of the upper blade plate 1*b* and has a bottom surface provided with a pull housing portion 32*a*-2 for accommodating the pull 1*a* in the erection state.

The second slider fixing portion 32*b* to be the other part is provided at such an interval as to hold the upper blade plate 1*b* and the lower blade plate 1*c* of the slider 1 together with the first slider fixing portion 32*a* as shown in FIG. 5.

The second slider fixing portion 32*b* serves to fit and support the lower blade plate 1*c* of the slider 1 and has a fitting concave portion 32*b*-1 which is coincident with the configuration of the contour of the lower blade plate 1*c*.

Each of the slider fixing portions 32*a* and 32*b* can be configured to be moved upward and downward in the same direction by a single operation through up-down driving means such as a cylinder (not shown) between a slider holding position in which the upper blade plate 1*b* and the lower blade plate 1*c* of the slider 1 are to be held and a slider inserting position in which the slider 1 is to be inserted into the fastener chain C, and to be opened or closed horizontally in the direction of the table diameter of the rotator 13 independently of the up-down driving means through horizontal driving means such as a cylinder which is not shown.

The operation of each of the slider fixing portions 32*a* and 32*b* can be sensed by a sensing device which is not shown. Each of the slider fixing portions 32*a* and 32*b* can be configured to automatically stop in the slider holding position in which the upper blade plate 1*b* and the lower blade plate 1*c* of the slider 1 are to be held and the slider inserting position in which the slider 1 is to be inserted into the fastener chain C. A portion between the slider fixing portions 32*a* and 32*b* serves as a space portion for guiding the rear port 1*d* of the slider 1 toward the element train ER of the fastener chain C held by each of the grippers 17.

Next, an operation in the slider attaching portion 30 will be described with reference to FIGS. 5 to 7.

The slider transferring portion 32 configured as described above stands by just below the chute 15*a* at such an interval as to avoid an interference with the horizontal portion 31*b* of the slider stopper portion 31 between the slider fixing portions 32*a* and 32*b*.

When the slider delivering feeder 15 is operated, the slider 1 slips down from the delivering feeder 15 through the chute 15*a*. In a state in which the pull 1*a* of the slider 1 thus slipping down is erected upward, an edge on the rear port side of the upper blade plate 1*b* of the slider 1 abuts on the horizontal portion 31*b* of the slider stopper portion 31 in a standby position shown in FIG. 5, thereby holding the slider 1 temporarily.

When the slider stopper portion 31 temporarily holds the slider 1, the slider transferring portion 32 starts to be lifted toward the slider 1. When the slider transferring portion 32 is lifted by a desirable distance beyond the horizontal portion 31*b* of the slider stopper portion 31, the first and second slider fixing portions 32*a* and 32*b* of the slider transferring portion 32 are horizontally moved in an closing direction to each other.

Consequently, the pull 1*a* of the slider 1 is accommodated and supported in the pull housing portion 32*a*-2 of the first slider fixing portion 32*a* , and furthermore, the upper blade plate 1*b* of the slider 1 is fitted and supported in the fitting concave portion 32*a*-1. At the same time, the lower blade plate 1*c* of the slider 1 is fitted and supported in the fitting concave portion 32*b*-1 of the second slider fixing portion 32*b*. Also in this state, the horizontal portion 31*b* of the slider stopper portion 31 stays below the slider transferring portion 32.

Next, the slider 1 is held in a non-operation state by the slider transferring portion 32 with the rear port 1*d* of the slider 1 turned toward the fastener stringer S, and the slider transferring portion 32 then starts to be moved downward. When the slider transferring portion 32 is continuously moved downward, the edge on the rear port side of the upper blade plate 1*b* of the slider 1 presses the horizontal portion 31*b* of the slider stopper portion 31 downward in an abutment condition.

When the slider transferring portion 32 is downward moved further continuously, the horizontal portion 31*b* of the slider stopper portion 31 is rotated in such a direction as to retreat from the chute 15*a* (the counterclockwise direction shown in the arrow of FIG. 5) by setting the upper part of the vertical portion 31*a* to be a rocking fulcrum with the downward movement of the first slider fixing portion 32*a* so that the horizontal portion 31*b* is retreated from the chute 15*a* against a spring force.

At the same time that the slider transferring portion 32 is moved downward beyond the horizontal portion 31*b* of the slider stopper portion 31, the horizontal portion 31*b* of the slider stopper portion 31 is rotated in the clockwise direction shown in the arrow of FIG. 5 by the spring force. The horizontal portion 31*b* is returned to an initial standby position shown in FIG. 5 and stands by to temporarily hold the new slider 1 slipping down from the slider delivering feeder 15 through the chute 15*a*. Thus, the slider stopper portion 31 can be reciprocated and rocked smoothly over a predetermined stroke in exact timing without requiring a special driving source.

When the slider transferring portion 32 is further moved downward beyond the horizontal portion 31*b* of the slider stopper portion 31, the first and second slider fixing portions 32*a* and 32*b* of the slider transferring portion 32 reach the vicinity of the upper part of the fastener chain C set in the mating state which is held by each of the grippers 17 as shown in FIG. 6.

As shown in FIG. 7, the upper end of each fastener stringer S is introduced from the space portion formed between the slider fixing portions 32*a* and 32*b* toward the rear port 1*d* of the slider 1. The fastener stringer S is introduced from the rear port 1*d* of the slider 1 to pass through a column portion erected between the upper blade plate 1*b* and the lower blade plate 1*c* of the slider 1, thereby separating and opening the element train ER of each fastener stringer S transversely. At this time, the grippers 17 are moved in a separating direction from each other in exact timing in the insertion of the slider 1 into the fastener stringer S.

Thus, each of the grippers 17 can move the fastener tape T in a predetermined direction. Consequently, the slider transferring portion 32 and the fastener stringer S can be aligned automatically and the slider 1 can be inserted into the fastener stringer S easily and efficiently.

After the machining in the slider attaching portion 30 is completed, each element train ER of the fastener chain C is intermittently rotated and transferred to the upper stopper attaching portion 40 of the third machining portion to be a next step while maintaining the transverse separating and opening state. The fastener chain C completely inserting the slider 1 therein is intermittently rotated and transferred to the upper stopper attaching portion 40, and at the same time, the fastener chain C held in the cutter portion 20 before the insertion of the slider is intermittently rotated and transferred to the slider attaching portion 30, and the same operation as the slider inserting operation is repeated.

Figure 8:
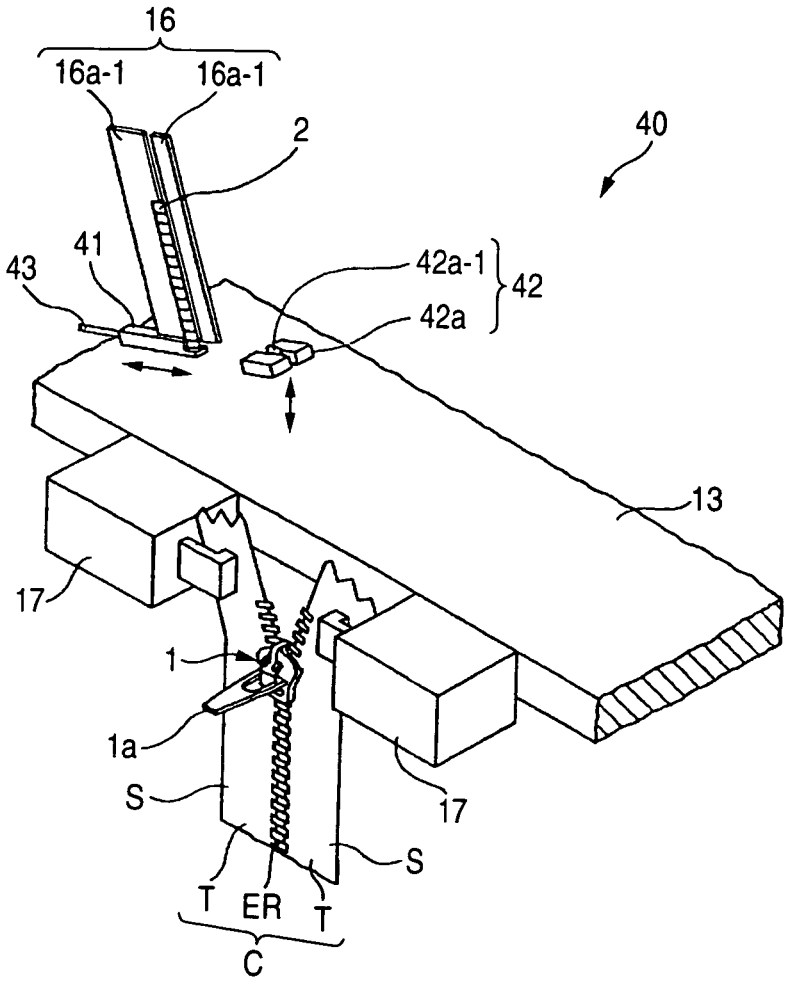
FIG. 8 is a perspective view showing the enlarged main part of an upper stopper attaching portion to be applied to the apparatus.
Figure 9:
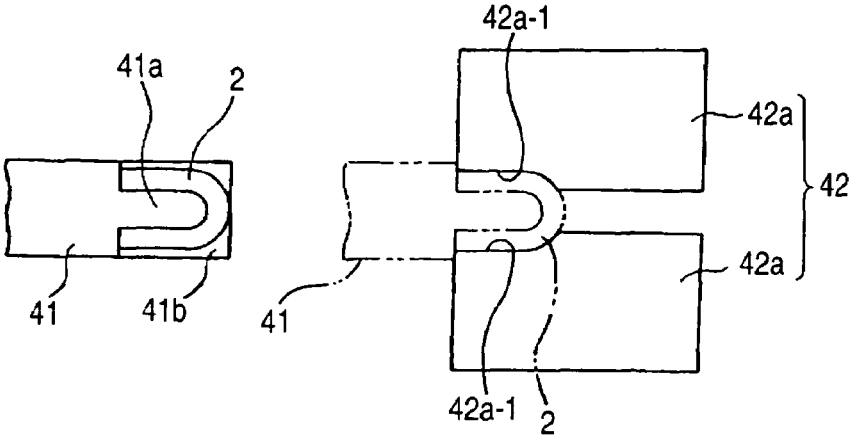
FIG. 9 is an explanatory view typically showing a state obtained immediately before an upper stopper is attached.
Figure 10:
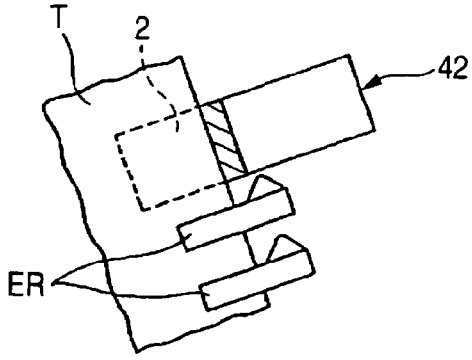
FIG. 10 is an explanatory view showing a subsequent operation to FIG. 9.

FIG. 8 shows the enlarged main part of the upper stopper attaching portion 40, FIG. 9 typically shows a state obtained immediately before the upper stopper 2 is attached, and FIG. 10 shows a subsequent operation to FIG. 9.

As shown in FIG. 8, the upper stopper attaching portion 40 includes an upper stopper taking portion 41 for holding a plurality of upper stoppers 2, . . . , 2 delivered continuously through an upper stopper delivering chute 16a (hereinafter referred to as a chute 16*a*) from the upper stopper delivering feeder 16. Furthermore, the upper stopper attaching portion 40 includes an upper stopper transferring portion 42 for transferring the single upper stopper 2 toward the fastener chain C held by a pair of grippers 17 and 17 rotated and transferred intermittently from the slider attaching portion 30. The upper stopper taking portion 41 can transfer the single upper stopper 2 toward the upper stopper transferring portion 42.

As shown in FIG. 8, the upper stopper attaching portion 40 is configured to introduce the metallic upper stopper 2 previously bent like an almost transverse U shape having two leg portions from the upper stopper delivering feeder 16 into an upper stopper introducing position through the chute 16*a*. The upstream side of the chute 16*a* is downward inclined and extended from the upper stopper delivering feeder 16 toward the upper stopper attaching portion 40 as shown in FIG. 1, and the downstream side of the chute 16*a* is bent and extended toward the upper stopper inserting position as shown in FIG. 8.

The chute 16*a* is configured by a pair of upper stopper introducing guide pieces 16*a*-1 and 16*a*-1 separated from each other at a predetermined interval as shown in FIG. 8. An upper stopper introducing guide space for aligning and introducing the upper stoppers 2, . . . , 2 is formed between the upper stopper introducing guide pieces 16*a*-1. The upper stopper introducing guide piece 16*a*-1 can insert and support the lower end of the upper stopper 2 with two opened leg portions turned toward the opposite side of the upper stopper transferring portion 42. The upper stopper introducing guide piece 16*a*-1 serves to introduce and guide the upper stopper 2 along the introducing guide space formed between the introducing guide pieces 16*a*-1 and to cause the upper stopper 2 to slip down.

The upper stopper taking portion 41 is configured by a block portion having the shape of a rectangular parallelepiped which is fixed to the tip portion of a piston rod 43 of a cylinder attached to a support portion which is not shown and extended in an orthogonal direction to the tip portion of the chute 16*a*. The body of the upper stopper taking portion 41 is provided to prevent the natural drop of the upper stopper 2 across the tip portion of the chute 16*a* during the operation of the upper stopper delivering feeder 16.

In the tip portion of the upper stopper taking portion 41, a fitting protrusion 41*a* to be fitted in a portion between the leg portions of the upper stopper 2 is extended forward from a middle portion in a transverse direction as shown in FIG. 9. A fitting step portion 41b for mounting the side end face of the upper stopper 2 is formed in the peripheral portion of the fitting protrusion 41*a*. The fitting step portion 41*b* constitutes a part of the upper stopper introducing guide space. The fitting protrusion 41*a* is configured to be reciprocated by the forward and backward movement of the piston rod 43 between the position of the lower end of the chute 16*a* and the position of the upper standby of the upper stopper transferring portion 42 as shown in FIG. 8.

The upper stopper transferring portion 42 is configured by first and second pressing portions 42*a* and 42*a* extended along the extended line of the upper stopper taking portion 41 above the chute 16*a* as shown in FIG. 8. The pressing portions 42*a* are provided on the same horizontal plane in an identical configuration to each other and are configured to freely close and separate each other. The pressing portions 42*a* can be assembled into the same support portion which is not shown and can be thus formed into a unit.

The pair of pressing portions 42*a* and 42*a* can be moved together by a simple operation in the same direction between an upper standby position in the vicinity of the upper stopper taking portion 41 and the fixing position of the upper stopper 2 by up-down moving and rotation driving means which is not shown. Furthermore, the pair of pressing portions 42*a* and 42*a* can be moved in opening and closing directions independently of the up-down moving and rotation driving means by press driving means such as a cylinder which is not shown. The pressing portions 42*a* are moved together between the upper standby position in the vicinity of the upper stopper taking portion 41 and the fixing position of the upper stopper 2. It is possible to have such a structure that each of the pressing portions 42*a* is automatically stopped by sensing these positions by means of a sensing device which is not shown.

A fitting concave portion 42*a*-1 penetrating vertically is formed in the opposed corner portions of the pressing portions 42*a* respectively. The fitting concave portion 42*a*-1 can insert, guide and hold the upper stopper 2 fitted and supported in the fitting protrusion 41*a* of the upper stopper taking portion 41 and can fasten and fix the upper stopper 2 to the element train ER of the fastener chain C held by the pair of grippers 17 and 17 as shown in FIGS. 9 and 10.

In the upper stopper attaching portion 40, the upper stopper taking portion 41 and the upper stopper transferring portion 42 can be provided to close to each other without interfering with the other machining portions, and a work for attaching the upper stopper 2 can be carried out easily and efficiently.

Next, an operation in the upper stopper attaching portion 40 will be described with reference to FIGS. 8 to 10.

The upper stopper taking portion 41 fits and supports one of the upper stoppers 2, . . . , 2 aligned and introduced into the chute 16*a* in the fitting protrusion 41*a* of the upper stopper taking portion 41 as shown in FIG. 8 and stands by in the tip position of the chute 16*a*. At this time, the upper stopper transferring portion 42 stands by in the upper standby position in the vicinity of the upper stopper taking portion 41.

When the cylinder of the upper stopper taking portion 41 is operated, the piston rod 43 is extended to singly move the upper stopper taking portion 41 toward the upper stopper transferring portion 42.

The upper stopper 2 is moved to the upper stopper transferring portion 42 in such a state as to be fitted and supported in the fitting protrusion 41*a* of the upper stopper taking portion 41 and the fitting protrusion 41*a* is pushed and introduced into the fitting concave portion 42*a*-1 of the upper stopper transferring portion 42 as shown in FIG. 9. When the upper stopper 2 is fitted in the fitting concave portion 42*a*-1, the movement of the upper stopper taking portion 41 is stopped.

After the upper stopper taking portion 41 is stopped, the upper stopper transferring portion 42 holds the upper stopper 2. With this state maintained, the upper stopper transferring portion 42 starts to be moved down toward one of the element trains ER of the fastener chain C held by the grippers 17. Simultaneously with the start of the operation for moving the upper stopper transferring portion 42 downward, the fitting protrusion 41*a* of the upper stopper taking portion 41 is returned to the tip position of the chute 16*a*.

When the two sharp leg portions of the upper stopper 2 reach one of the relative fastener tapes 2 with the downward movement of the upper stopper transferring portion 42, the left and right leg portions of the upper stopper 2 are inserted through the fastener tape T across the upper end of the element train ER set in an opening state as shown in FIG. 10. At the same time, the left and right leg portions of the upper stopper 2 are bent like an almost inverse C shape inward from each other in the fitting concave portion 42*a*-1 of each of the pressing portions 42*a* by the press of the upper stopper transferring portion 42 and are attached to the fastener tape T.

While the upper stopper 2 is attached to either of the fastener tapes T in the embodiment, the invention is not restricted thereto but the operation may be repeated to continuously attach the upper stopper 2 to one of the element trains ER after the work for attaching the upper stopper 2 to the other element train ER is completed, for example.

In this case, two upper stopper attaching portions 40 may be provided adjacently in the fixed table portion 12. Moreover, it is also possible to invert the upper stopper transferring portion 42 toward the other element train ER by the up-down moving and rotation driving means which is not shown, thereby moving the upper stopper transferring portion 42 from the upper standby position in the vicinity of the upper stopper taking portion 41 to the fixing position of the upper stopper 2. If the element train of the slide fastener is formed of a synthetic resin, a wire for the stopper formed of the synthetic resin can also be used to supply the wire for the stopper to the element train of the fastener chain and to then pressurize, heat and attach the same wire by an ultrasonic machining. The ultrasonic machining is performed by a fixing portion including an ultrasonic horn and an anvil.

When the upper stopper 2 is completely attached, thus, the upper stopper transferring portion 42 is returned to the upper standby position in the vicinity of the upper stopper taking portion 41 so that all of the operations are completed. In a state in which each element train ER is transversely separated and opened, the fastener chain C is intermittently rotated and transferred to the pull erecting portion 50 for the slider 1 of the fourth processed portion to be a next step through the rotator 13.

At the same time that the fastener chain C having the upper stopper 2 completely attached thereto is intermittently rotated and transferred to the pull erecting portion 50, the fastener chain C delivered from the slider attaching portion 30 is intermittently rotated and moved to the upper stopper attaching portion 40 and the same operation as the operation for attaching the upper stopper is repeated.

Figure 11:
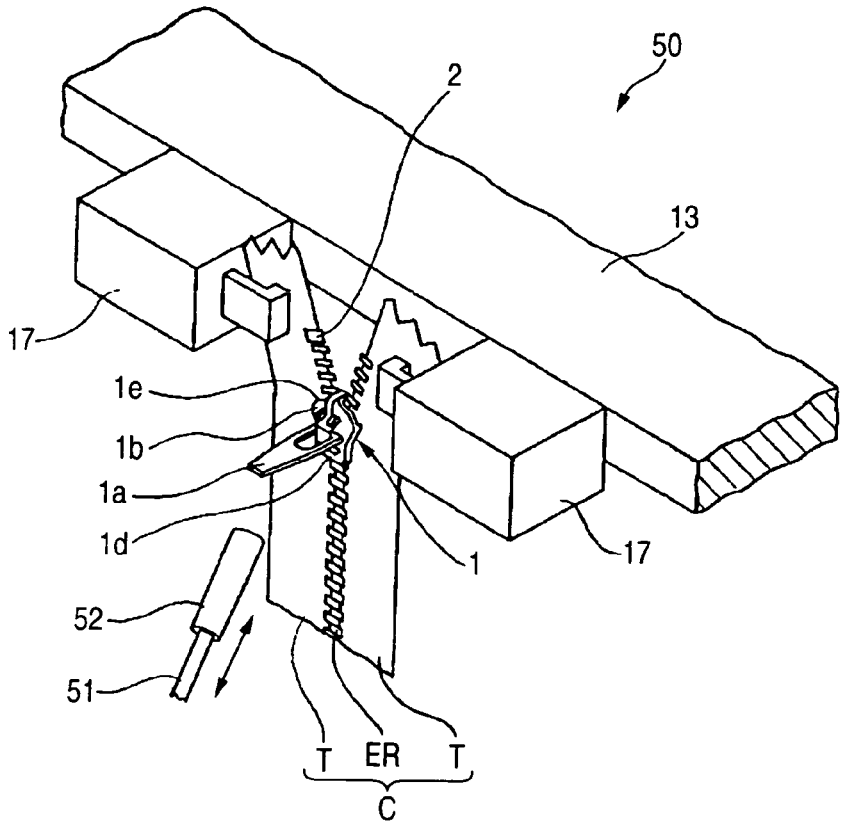
FIG. 11 is a perspective view showing the enlarged main part of a pull erecting portion to be applied to the apparatus.
Figure 12:
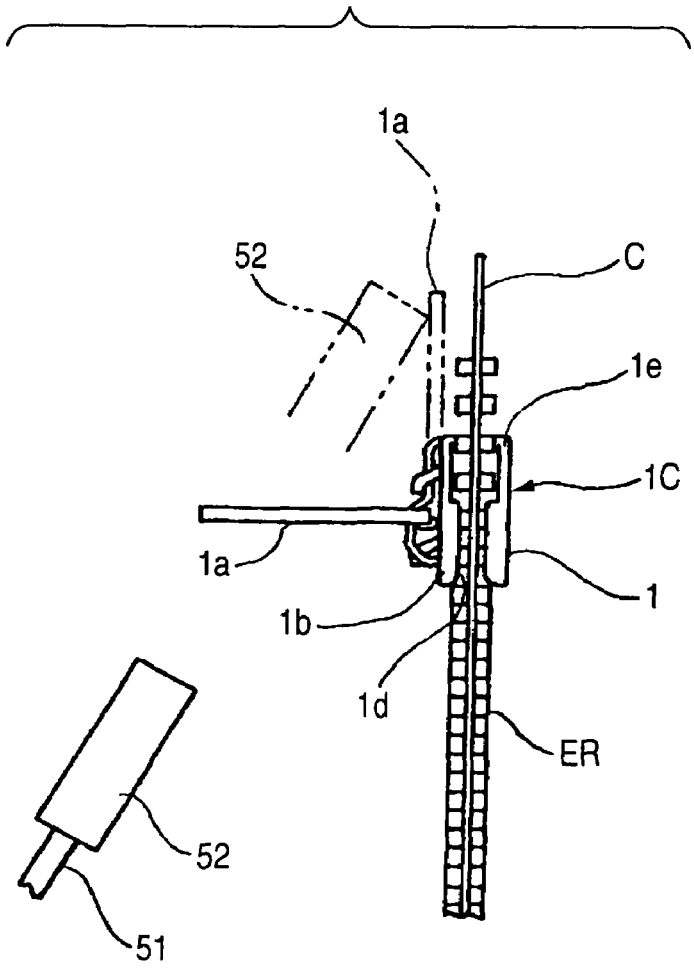
FIG. 12 is an explanatory view typically showing an operation for bringing down the pull of the slider.

FIG. 11 shows the enlarged main part of the pull erecting portion 50 for the slider 1 and FIG. 12 typically shows an operation for bringing down the pull 1*d* of the slider 1.

As shown in FIG. 11, the pull erecting portion 50 is provided with a pressing bar 52 fixed to the tip portion of a piston rod 51 of the cylinder attached to the support portion which is not shown. The pressing bar 52 is configured by a cylindrical block portion extended to the shaft portion of the cylinder.

The pressing bar 52 is provided in a standby position placed below each of the grippers 17 holding the fastener chain C rotated and transferred intermittently from the upper stopper attaching portion 40 in a state in which the pull 1*a* of the slider 1 is erected upward as shown in FIG. 11. The pressing bar 52 can close to and separate from the pull 1*a* based on the operation of the piston rod 51, and can be configured to sense the standby position placed below each of the grippers 17 and a position in which the pull 1*a* is to be brought down by means of a sensing device which is not shown, thereby automatically carrying out a stoppage.

When the pressing bar 52 is moved toward the pull 1*a* based on the extending motion of the piston rod 51 as shown in FIG. 12, the pull 1*a* is brought down from the rear port 1*d* of the slider 1 toward a shoulder port 1*e* by the press of the pressing bar 52. When the pull 1*a* is horizontally brought down toward the shoulder port 1*e* of the slider 1, the pressing operation of the pressing bar 52 is stopped. After the pressing bar 52 is stopped, it is returned to the standby position placed below each of the grippers 17 based on the contracting motion of the piston rod 51. In place of the pressing bar 52, it is also possible to erect the pull 1*a* upward by injecting compressed air toward the pull 1*a*.

When the pull 1*a* is completely brought down in the pull erecting portion 50, thus, the fastener chain C having the pull 1*a* completely brought down is intermittently rotated and transferred to the chain discharging portion 60 to be a next step through the rotator 13. At the same time that the fastener chain C is intermittently rotated and transferred to the chain discharging portion 60, the fastener chain C held in the upper stopper attaching portion 40 is intermittently rotated and moved to the pull erecting portion 50 and the same operation as the pull erecting operation is repeated.

Figure 13:
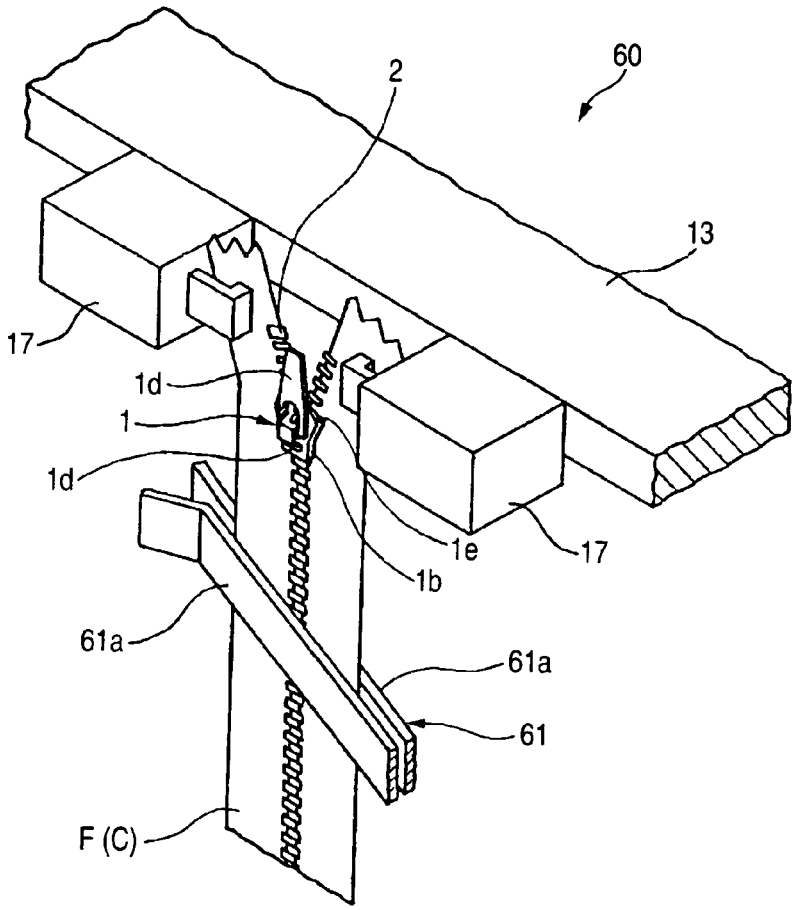
FIG. 13 is a perspective view showing the enlarged main part of a chain discharging portion to be applied to the apparatus.
Figure 14:
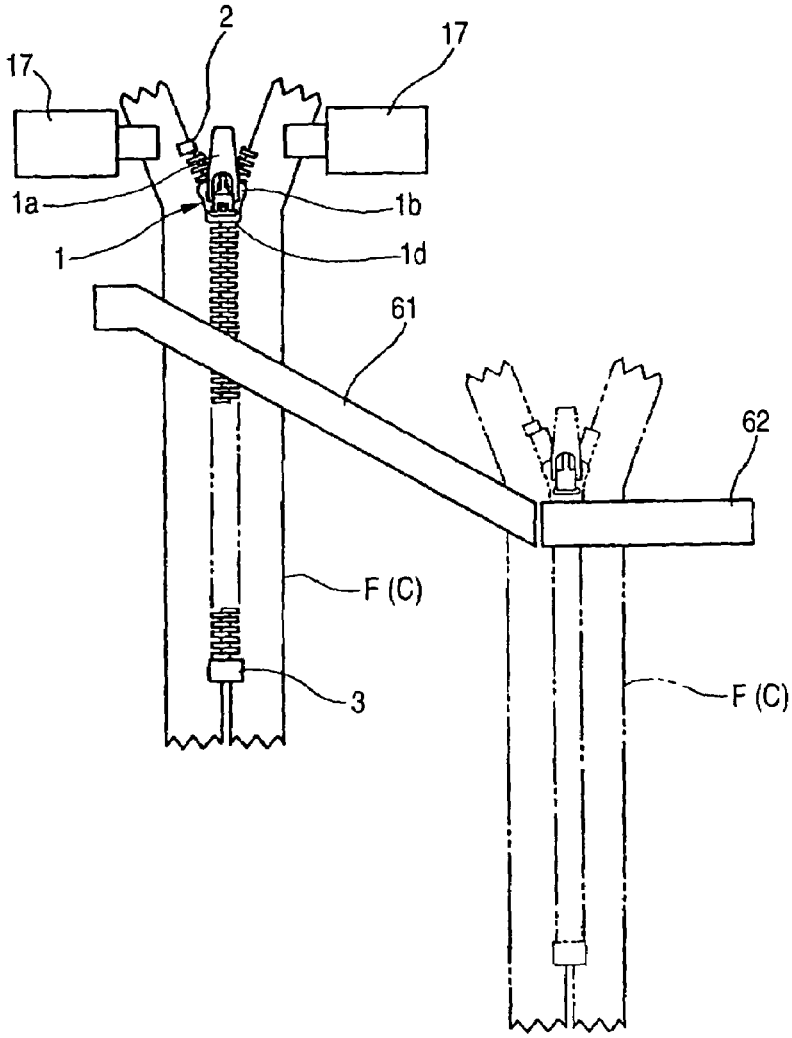
FIG. 14 is an explanatory view typically showing an operation for discharging a slide fastener.

FIG. 13 shows the enlarged main part of the chain discharging portion 60 and FIG. 14 typically shows an operation for discharging a slide fastener F.

In these drawings, the chain discharging portion 60 is provided with a chain discharging chute 61 toward the fastener chain C which is intermittently rotated and transferred from the pull erecting portion 50 in a state in which the left and right element trains ER and ER are separated and opened. The chain discharging chute 61 is downward inclined and extended from the position placed below each of the grippers 17 holding the fastener chain C to a position in which the fastener chain C is to be stored, and can be configured to feed the fastener chain C from an end on the downstream side of the chain discharging chute 61 toward a chain storing portion 62.

The chain discharging chute 61 is configured by a pair of chain introducing guide pieces 61*a* and 61*a* separated from each other at a predetermined interval for introducing the fastener chain C. The opposed surfaces of ends on the upstream side of the chain of the chain introducing guide pieces 61*a* are formed to be taper surfaces in such a manner that they are enlarged toward an introducing side and are gradually narrowed in a discharging direction. A space formed between the opposed surfaces of the chain introducing guide pieces 61*a* is formed linearly and continuously to a chain transfer space extended to the chain storing portion 62.

The fastener chain C rotated and transferred from the pull erecting portion 50 is introduced into the chain transfer space formed between the opposed surfaces of the chain introducing guide pieces 61*a* through the taper surface formed on the inlet of the chain introducing guide piece 61*a* as shown in FIGS. 13 and 14.

The fastener chain C thus introduced releases the holding state of the pair of left and right grippers 17 and 17 holding the left and right fastener tapes T and T of the fastener chain C while passing through the inside of the chain transfer space between the opposed surfaces of the chain introducing guide pieces 61*a*. When the hold of the grippers 17 is released, the fastener chain C is dropped toward the chain discharging chute 61 and an edge on the rear port side of the slider 1 of the fastener chain C abuts on the chain discharging chute 61.

At this time, the pair of left and right grippers 17 and 17 is returned to the original initial state. The fastener chain C slips down along the chain discharging chute 61 along the edge on the rear port side of the slider 1. The fastener chain C passes through the inside of the chain transfer space of the chain discharging chute 61 and is then fed into the chain storing portion 62 as shown in FIG. 14. Thus, all the machining for the fastener chain C are completed and the slide fastener F to be a finished product is then taken out of the chain storing portion 62.

After the necessary machining for the fastener chains C rotated and transferred intermittently are carried out for each of the cutter portion 20, the slider attaching portion 30 and the upper stopper attaching portion 40, thus, the fastener chains C can be rotated and transferred simultaneously and intermittently to the next machining portion and the predetermined machining can be performed in each of the machining portions 20 to 40. Consequently, a large number of fastener chains C, . . . , C can be continuously processed in order of the machining at the same time.

The slide fastener manufacturing apparatus 10 according to the embodiment can rotate and transfer all of the fastener chains C to the next machining portion simultaneously and intermittently every time a predetermined machining for the fastener chain C rotated and transferred intermittently to the cutter portion 20, the slider attaching portion 30 and the upper stopper attaching portion 40 is carried out. Consequently, all of the fastener chains C can be continuously processed in order of the machining at the same time, and a time required for the manufacture of the slide fastener manufacturing apparatus 10 can be shortened. As a result, a machining cost per product can be reduced, and furthermore, the output of a product can be increased.

Figure 15:
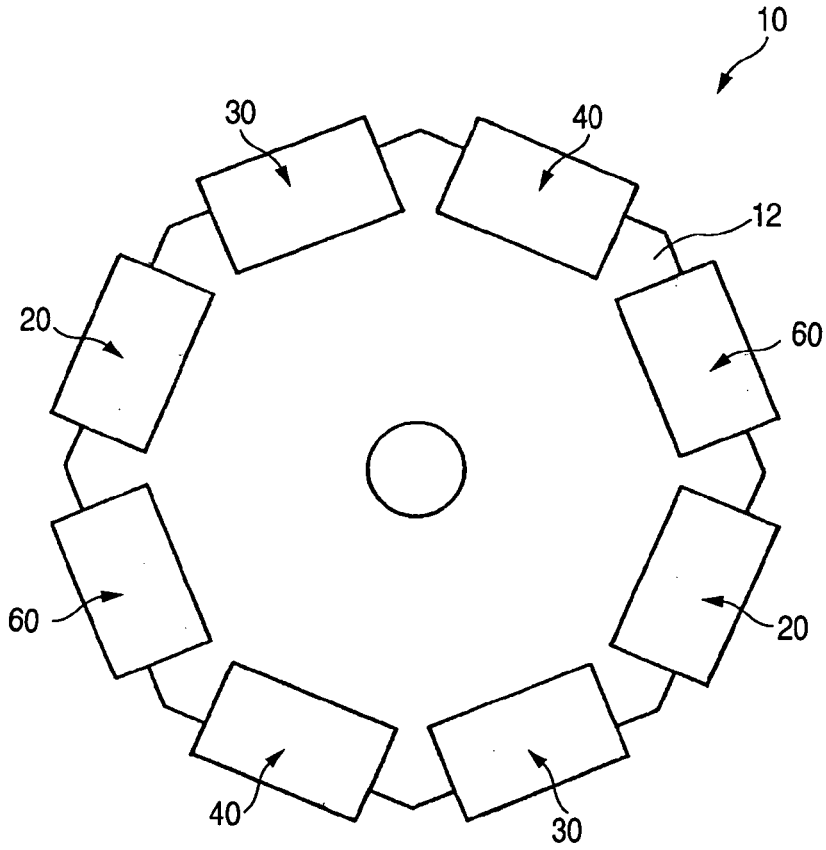
FIG. 15 is a plan view showing a variant of the apparatus.
Figure 16:
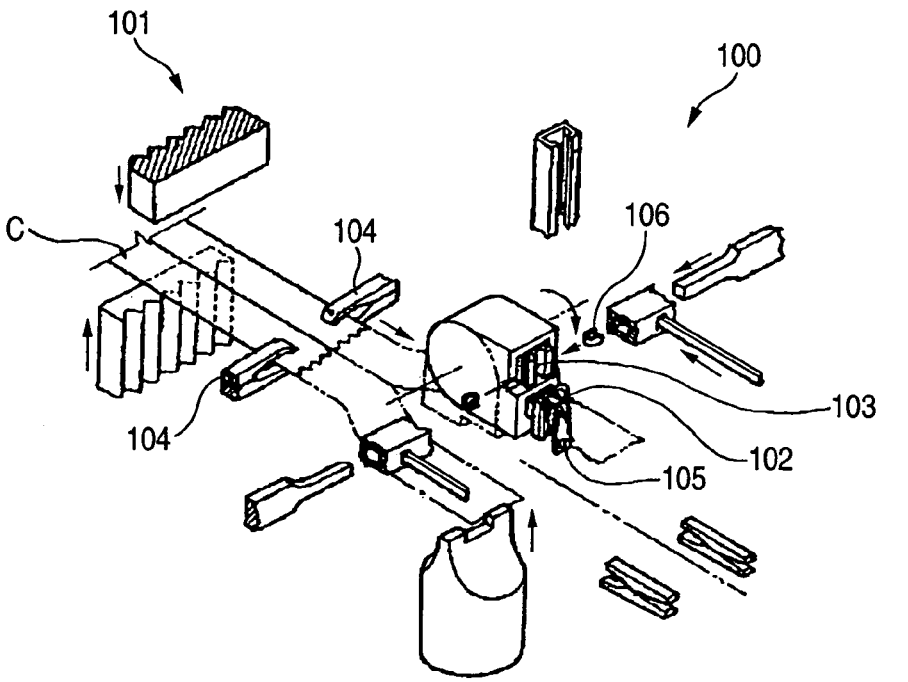
FIG. 16 PRIOR ART
FIG. 16 is a view showing a conventional slide fastener manufacturing apparatus.

FIG. 15 shows a variant of the slide fastener manufacturing apparatus 10 which takes the shape of a rotary dividing table. In FIG. 15, the slide fastener manufacturing apparatus 10 has a cutter portion 20, a slider attaching portion 30, an upper stopper attaching portion 40 and a chain discharging portion 60 provided at a predetermined angle around the vertical axis of a shaft portion in order of machining every half part of a fixed table portion 12 fixed through the shaft portion above a base which is not shown. In the example shown in the drawing, the same machining portions are provided with a phase difference of 180 degrees in the circumferential direction of the fixed table portion 12.

The slide fastener manufacturing apparatus 10 according to the variant comprises the cutter portion 20, the slider attaching portion 30, the upper stopper attaching portion 40 and the chain discharging portion 60 every half part of the fixed table portion 12. Therefore, more fastener chains C than those in the slide fastener manufacturing apparatus 10 according to the embodiment can be processed in parallel at the same time. As a result, a time required for the manufacture of the slide fastener manufacturing apparatus 10 can be shortened considerably as compared with the embodiment. In addition, a machining cost per product can be reduced sharply so that the output of the product can be increased greatly.

The invention is not restricted to the embodiment and the variant but the optional numbers of necessary machining and processed portions can be provided around the same vertical axis of the fixed table portion with a predetermined phase difference in order of the machining, for example, and it is a matter of course that the technical scope which can be easily changed from the embodiment and the variant by the skilled in the art is also included therein.

What is claimed is:

1. A slide fastener manufacturing apparatus for manufacturing a slide fastener, comprising:

a fixed table portion;

a plurality of manufacturing portions including a machining portion for machining a fastener chain and at least one assembly portion for assembling the fastener chain to at least one of a slider and an upper stopper to manufacture the slide fastener, each of the manufacturing portions is provided at the fixed table portion at a predetermined angle about a central axis of the table and in order of the manufacturing operations by the plurality of the manufacturing portions;

a rotator for intermittently rotating at the predetermined angle and in parallel with the fixed table portion in a direction about the central axis thereof;

and a plurality of holding portions for holding the fastener chain, each of the holding portions is disposed at the rotator at the predetermined angle.

2. The slide fastener manufacturing apparatus according to claim 1, wherein each holding portion has:

a pair of left and right grippers for holding the fastener chain; and operating portions for operating the pair of grippers to be closed or be separated each other.

3. The slide fastener manufacturing apparatus according to claim 1, wherein the machining portion has a cutter portion for cutting the fastener chain to have a predetermined length;

wherein the at least one assembly portion includes:

a slider attaching portion for attaching a slider to the fastener chain cut by the cutter portion; and an upper stopper attaching portion for attaching an upper stopper to the fastener chain to which the slider is attached;

and the slide fastener manufacturing apparatus also including a chain discharging portion for discharging a slide fastener as the fastener chain to which the slider and the upper stopper is attached out of a rotation and transfer path of the rotator.

4. The slide fastener manufacturing apparatus according to claim 3, wherein the cutter portion has:

chain delivering portions for delivering the fastener chain toward the respective holding portion;

and a cutting blade for cutting the fastener chain delivered by the chain delivering portions.

5. The slide fastener manufacturing apparatus according to claim 3, wherein the slider attaching portion includes:

a slider delivering chute for delivering the slider;

a slider stopper portion, which is urged on the slider delivering chute, for temporarily holding the slider delivered though the slider delivering chute;

and a slider transferring portion for moving toward and backward the slider stopper portion to transfer the slider held by the slider stopper portion one by one, wherein when the slider transferring portion transfers the slider to a position where the slider is to be attached to the fastener chain, the slider stopper portion moves to an outside of a path of the slider transferring portion against an urging force thereof with the movement of the slider transferring portion, the slider stopper portion then returns to an original position by the urging force after the slider transferring portion moves beyond the slider stopper portion.

6. The slide fastener manufacturing apparatus according to claim 5, wherein the slider transferring portion has: a first slider fixing portion for supporting an upper blade plate of the slider; and a second slider fixing portion for supporting a lower blade plate of the slider, wherein the first slider fixing portion and the second slider fixing portion are closed or separated relative to each other.

7. The slide fastener manufacturing apparatus according to claim 3, wherein the upper stopper attaching portion includes:

an upper stopper delivering chute for aligning and delivering a plurality of upper stoppers;

an upper stopper taking portion for taking the upper stoppers one by one out of the upper stopper delivering chute; and an upper stopper transferring portion for transferring the upper stopper taken out by the upper stopper taking portion to a position where the upper stopper is to be attached to the fastener chain, and the upper stopper transferring portion includes a fastening portion for fastening the upper stopper to the fastener chain.

8. The slide fastener manufacturing apparatus according to claim 7, wherein each upper stopper is in a U shape having two leg portions, and the upper stopper taking portion has a fitting protrusion for fitting between the leg portions to support one of the upper stoppers.

9. The slide fastener manufacturing apparatus according to claim 7, wherein the fastening portion has a pair of first and second pressing portions which close or separate relative to each other;

wherein the upper stopper taking portion has a fitting protrusion for supporting one of the upper stoppers, and each of the pressing portions has a fitting concave portion to which the upper stopper supported by the fitting protrusion of the upper stopper taking portion is inserted.

10. The slide fastener manufacturing apparatus according to claim 1, wherein each of the manufacturing portions has a driving portion to be independently operated respectively.

11. The slide fastener manufacturing apparatus according to claim 1, wherein the manufacturing portions are provided at an edge of the fixed table portion, and the holding portions are disposed at an edge of the rotator.

12. The slide fastener manufacturing apparatus according to claim 1, wherein the manufacturing portions are provided around a vertical axis of the fixed table portion, and the rotator is provided to enable the holding portions to rotate around the vertical axis.

* * * * *